United States Patent [19]

Dean

[11] Patent Number: 5,011,548

[45] Date of Patent: Apr. 30, 1991

[54] COMPOSITION FOR DEBORONIZING GRAIN-ORIENTED SILICON STEEL

[75] Inventor: Douglas C. Dean, Pittsburgh, Pa.

[73] Assignee: Allegheny Ludlum Corporation, Pittsburgh, Pa.

[21] Appl. No.: 225,689

[22] Filed: Jul. 28, 1988

Related U.S. Application Data

[62] Division of Ser. No. 57,559, Jun. 3, 1987, Pat. No. 4,798,873.

[51] Int. Cl.[5] ..... C21D 1/70

[52] U.S. Cl. ..... 148/27; 148/28

[58] Field of Search ..... 148/27, 28, 113; 106/286.6; 75/307

[56] References Cited

U.S. PATENT DOCUMENTS

| | | | |
|---|---|---|---|
| 3,151,000 | 9/1964 | Schmidt et al. | 148/113 |
| 3,785,879 | 1/1974 | Lee et al. | 148/27 |
| 3,941,621 | 3/1976 | Lee et al. | 148/113 |

FOREIGN PATENT DOCUMENTS 44395 10/1985 Japan .

*Primary Examiner*—Melvyn J. Andrews
*Attorney, Agent, or Firm*—Patrick J. Viccaro

[57] ABSTRACT

For making a ductile boron-containing grain-oriented silicon steel, there is practiced, at a late stage in the making of the product either during the final texture anneal or a subsequent anneal, a high-temperature anneal in a reducing atmosphere with the use of a separating-agent coating, particularly magnesium oxide, which contains an effective amount of a compound of molybdenum and/or tungsten.

5 Claims, 2 Drawing Sheets

COMPOSITION FOR DEBORONIZING GRAIN-ORIENTED SILICON STEEL

This is a division of application Ser. No. 057,559, filed June 3, 1987 now U.S. Pat. No. 4,793,873, issued Dec. 27, 1988.

BACKGROUND OF THE INVENTION

1. Field of the Invention

This invention relates to the production of high-permeability grain-oriented silicon steel, and in particular, it relates to the making of such steel which contains boron and is ductile, as is evidenced by the ability of the steel, in the form of strip or sheet to withstand a number of 180-degree bends before rupturing.

2. Description of the Prior Art

Those skilled in the art of making specialty steels are familiar with the making of grain-oriented silicon-containing electrical steels in the form of sheets of steel having a thickness of 14 mils or less, or in the form of a coiled strip of steel of such thickness, from which sheets may be cut. The product is used, for example, for the making of transformers, which may be of either the "wound" or the "stacked" type.

The known process or processes for the making of such product involve, as a first step, the melting of a steel of suitable chemical composition. In general, this is a steel which consists essentially of iron plus about 2.5 to 4 weight percent of silicon. Such steel is then solidified and subjected to a series of hot-rolling and cold-rolling operations, usually with intermediate annealings, given a decarburizing annealing, and then provided with a coating (typically mainly magnesium oxide, applied to the steel as a slurry and dried) and coiled and given a final texturing anneal, in which the desired grain-oriented texture is developed Thereafter, the steel is scrubbed to remove the separator coating, and the steel is then applied to its intended uses as indicated above.

There have developed in recent years certain approaches to the making of high-permeability, low-core-loss grain-oriented silicon steel, in accordance with which the steel is caused to contain either nitrides of aluminum and/or sulfides or selenides or in another approach, boron, alone or with nitrogen, as in U.S. Pat. Nos. 3,905,842 and 4,096,001. A practice of including boron in the magnesium oxide separator-material coating which is applied before the final texturizing anneal is disclosed in U.S. Pat. No. 4,096,001.

A practice of applying to the steel, after the final texturizing anneal, a coating based on magnesium oxide and also containing boron, and giving the so-coated steel a further heat treatment involving a slow cooling, to improve the core-loss properties, is the subject of a copending U.S. application, Ser. No. 852,058, filed Apr. 15, 1986.

It is known, for example, from an article entitled "High Resolution Investigation of Influence of Boron on Fine-Scale Intergranular Microstructure of 316 L Stainless Steel", by L. Karlsson and H. Norden, Stainless Steel '84 [Proceedings of Conference]Chalmers University of Technology, Goteborg, Sweden, 3–4 Sept. 1984, published by the Institute of Metals in London, that boron is particularly reactive with molybdenum to form a molybdenum boride, $Mo_2B_5$. It is also generally known in metallurgy that tungsten behaves similarly to molybdenum when substituted therefor on a 2:1 weight basis.

The high-permeability grain-oriented silicon steels made from boron-containing steel have, prior to the present invention, been poor in ductility, when that property is measured in terms of an ability to withstand some number of 180-degree bends without breaking. Such steel tends to contain iron-boride particles at or near the surface, and such particles, which are very hard and in a matrix not much softer, tend to serve as crack-initiation sites when the steel is bent.

There has not been in the prior art, to the inventor's knowledge, any teaching or suggestion to the effect that molybdenum and/or tungsten or any compound thereof be used as a component of the refractory-oxide coating composition, particularly one based on magnesium oxide, for the purpose of influencing favorably the ductility of the product steel.

There is a teaching, however, in Japanese Patent No. 44,395 of 1985, to the effect that it is desirable to add, in an amount of 0.1 to 10 weight percent, relative to the magnesium oxide, a fine metal powder, with the metal being selected from the group consisting of aluminum, silicon, titanium, chromium, zirconium, niobium, tin, tungsten, and/or molybdenum in order to improve the core-loss properties of the product silicon-steel sheets. This reference stresses the concept of adding the molybdenum or the like in the form of a fine powder of the free metal, as a way of adjusting the oxidation potential of the separating-material coating. The free metal acts as a getter, reacting with any oxygen or water which is released by decomposition of the magnesium oxide coating during the texturizing anneal. To those skilled in the art, this reference thus does not suggest that it would be useful to add to the separating-material coating any molybdenum or tungsten in the form of a compound of molybdenum or tungsten, such as molybdenum trioxide or tungstic acid, which is a compound with oxygen.

SUMMARY OF THE INVENTION

For making a ductile grain-oriented silicon steel, there is practiced, at a late stage in the making of the product during the texturing anneal or, subsequently, a high-temperature anneal in a reducing atmosphere with the use of a separating-agent coating, particularly magnesium oxide, which contains an effective amount of a compound of molybdenum and/or tungsten. This ductilizes such boron-containing grain-oriented silicon steel. Surprisingly, the coatings containing $MoO_3$ or $WO_3$ during the heat treatment result in boron migrating out of the steel, and this happens without substantial detriment to the core-loss values which one might expect in view of the above-mentioned copending application Ser. No. 852,058, filed Apr. 15, 1986 now U.S. Pat. No. 4,666,535.

DESCRIPTION OF THE DRAWINGS

A complete understanding of the invention may be obtained from the foregoing and following description thereof, taken in conjunction with the appended drawings, in which.

DESCRIPTION OF THE PREFERRED EMBODIMENTS

In general, this invention relates to the concept that it is useful to employ molybdenum and/or tungsten, preferably the former, and preferably in the form of a suitable compound of such metal, as an ingredient of the separating-agent coating which is used in one of the final high-temperature annealing steps used in the making of boron-containing grain-oriented silicon steel, to improve the ductility.

In general, the idea is that if there is a compound of molybdenum or tungsten present in the magnesium oxide separating material in an appropriate and effective amount, and, especially when the product being made is a high-permeability, low-core-loss grain-oriented silicon steel, then the molybdenum compound or tungsten compound present in the separating-agent coating will operate substantially in such manner as to remove the boron, in the form of borides, from the steel and improve its ductility, as determined by 180-degree bend tests.

In one aspect of the invention, the molybdenum or tungsten compound is added to the separating-agent coating based on magnesium oxide along with the boron (such as boric acid) which is present in the coating which is applied to the steel before the final texture anneal.

In another aspect, the invention relates to the use of a similar separating-medium coating, but one which is applied to the silicon steel only after the final texture annealing.

In each case, the objective is to have present in the steel a suitable quantity of boron to improve meagnetic properties preferably during the stage of developing the desired grain-oriented texture therein, but at the same time, to avoid the penalty with respect to achieving desirable ductility properties which is suffered if the boron introduced into the steel is permitted to remain therein.

It appears that the best mode of practicing the invention differs somewhat, depending upon whether the high-temperature anneal in a reducing atmosphere which is used, in conjunction with a separating-agent coating containing an effective amount of a compound or molybdenum or tungsten, is, on the one hand, a separate annealing operation, conducted after the final high-temperature texture anneal, or on the other hand, it is the final texture anneal itself.

Figure 2:
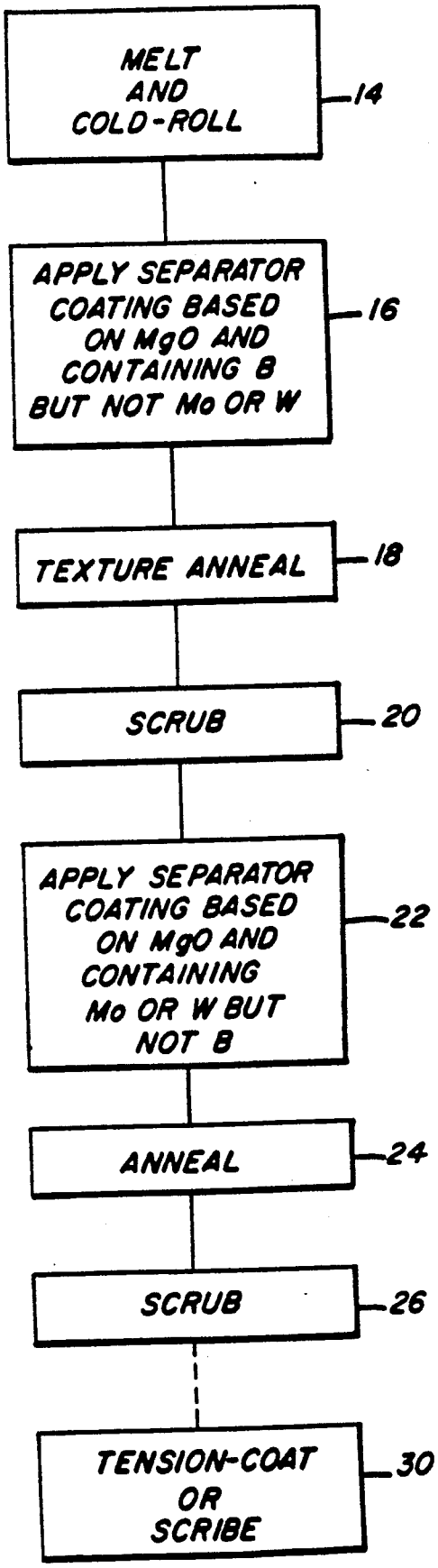
FIG. 2 is a flow diagram of a process in accordance with the invention in another embodiment using a separate annealing operation, subsequent to the texturizing anneal, with a separating-agent coating based on magnesium oxide, to which a compound of molybdenum and/or tungsten is added to remove boron from the steel and ductilize the product.

In the former case, the "recoat" case shown in FIG. 2, it is desirable to use a separating-agent coating which is based on magnesium oxide and contains some suitable proportion, on the order of 5 to 20 weight percent, based on the magnesium oxide, of a suitable compound of molybdenum, such as molybdenum trioxide, or 10 to 20 weight percent, same basis, of a suitable compound of tungsten, such as tungstic acid or tungsten trioxide. Research reveals that, if there is to be a separate annealing operation after the final texture anneal, best results are obtained with a separating-agent coating which contains molybdenum and/or tungsten but no boron.

On the other hand, it has also been discovered that the compounds of molybdenum and/or tungsten can be used for their effect towards promoting the ductility of the product steel if they are merely incorporated, to an appropriate weight percentage, based on the magnesium oxide, within the magnesium oxide separating-agent coating which is ordinarily used during the final texturizing anneal. In this case, the "green coating" case of FIG. 1, molybdenum would be added to the extent of 10 to 20 weight percent, or tungsten to the extent of 15 to 20 weight percent, based on the magnesium oxide.

It was discovered, first, that it would be possible to practice a separate annealing operation, after final texture annealing, with the use of a separating-agent composition containing added molybdenum trioxide. The molybdenum in the separating-agent coating did not migrate into the steel, but the boron contained in the steel tended to migrate into the separating-agent coating or at least to the interface and diffuse out of the steel, leaving the steel ductile. This took place to some extent, whether or not the separating-agent composition itself also contained boric acid, in accordance with the invention of copending application Ser. No. 852,058, filed Apr. 15, 1986 now U.S. Pat. No. 4,666,535. The experimental results revealed that when a subsequent coating and anneal is to be practiced after the final texture anneal, it is preferred to use for the latter coating and annealing a coating which contains molybdenum or tungsten in the form of one of its suitable compounds but not any boron or boron compound, such as boric acid.

Getting the desired result, a steel with enhanced ductility, also generally depends upon having the coated steel thereafter being subjected to a sufficient heat treatment. Enhanced ductility appears to depend upon having boron removed from the steel by diffusion. What is enough, in terms of severity of heat treatment (hours at a given temperature), appears to depend not only on the concentration of molybdenum or tungsten in the coating but also on the steel being treated. Other things being equal, and within limits, a satisfactory improvement in ductility, such as an ability to withstand 5 or more bends of 180 degrees, may be obtained, even with a relatively broad range of coating-composition content of molybdenum or tungsten compound, if the subsequent heat treatment is as severe as 4 or 5 hours in hydrogen at 2100 degrees Fahrenheit. A satisfactory improvement can sometimes be achieved with conditions less severe, such as 2 hours at 2100 degrees Fahrenheit or 10 hours at 1650 degrees Fahrenheit. Conditions more severe, like 15 hours at 2100 degrees Fahrenheit, do not usually yield any worthwhile improvement in ductility over that obtained in 5 hours at that temperature, although with some steels and/or some coating compositions, they may, or they may actually sometimes yield poorer results. Ideally, one seeks to obtain a maximum of improvement in properties with a minimum of severity of heat treatment.

It has also developed, when tests were conducted to see whether the ductilizing effect of using molybdenum and/or tungsten compounds in the separating-agent composition could also be obtained with the use of such a composition during the final texture anneal, that a ductile product with suitable permeability and low core-loss values could be obtained in that way.

Figure 1:
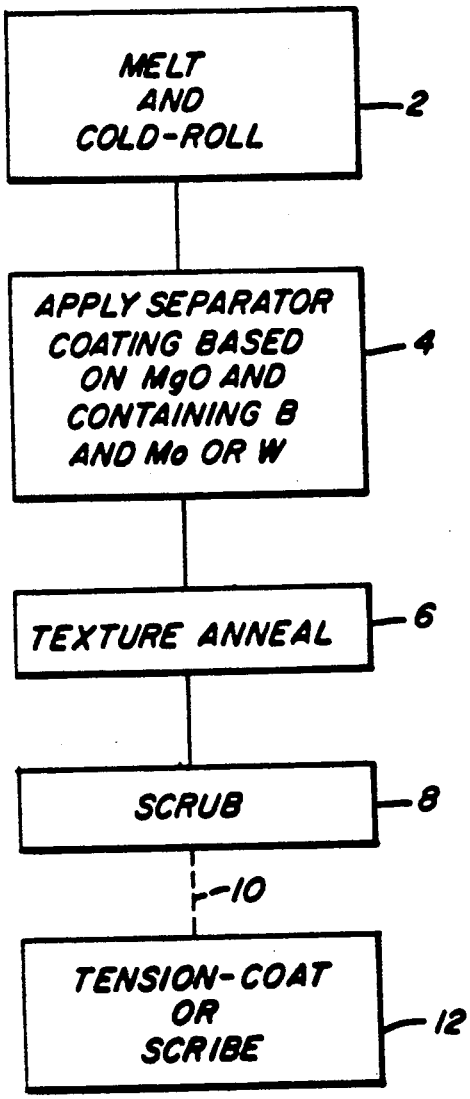
FIG. 1 is a flow diagram of a process in accordance with the invention, in an embodiment using a compound of molybdenum and/or tungsten during the final texturizing anneal to remove boron from the steel and obtain a ductile product.

The invention, in its aspect of being practiced by adding the molybdenum or tungsten compound to the separating-agent composition used in connection with the final texture annealing is indicated in the drawings in the attached FIG. 1.

The box 2 indicates conventional processing which may be used, including the initial steps of melting and processing through final normalizing of the grain-oriented silicon steel, up to the stage, indicated by the box 4. Box 4 represents applying a separator coating which is based on magnesium oxide and preferably contains boron (e.g. boric acid) and also contains, in accordance with the invention, a suitable proportion of a compound of molybdenum and/or tungsten.

As those skilled in the art will appreciate, this step may be conducted by making a slurry with 40 gallons of water, 50 pounds of magnesium oxide, some suitable amount such as 1 to 20 pounds of boric acid, and some effective amount of a molybdenum or tungsten compound, such as 9 pounds or 18 pounds of molybdenum trioxide. Such a coating is customarily applied by passing the grain-oriented silicon steel in strip form through a slurry bath and then suitably drying it such as in a tower furnace.

Silicon-steel strips so coated are then subjected, as indicated in the box 6, to a final texture anneal, which may be performed under suitable conditions, as known to those skilled in the art. Such anneal customarily provides adequate opportunity for boron diffusion in accordance with criteria explained above.

After the texture anneal, there is, as indicated by the box 8, a step of scrubbing the steel to remove the unreacted separating-agent coating, and then, as indicated by the dotted line 10, there is, as indicated by the box 12, an optional step of further processing the steel, by tension-coating or scribing, to improve further the electrical properties.

FIG. 1 describes a method wherein the molybdenum or tungsten has its effect as a result of being included along with the MgO as a part of the separator coating that is applied immediately before the final texture annealing step. Practicing the invention in this manner is dependent upon it being possible to obtain both the benefits of having boron being present in the steel during the final texture anneal step for its effect of selectively favoring the growth of grains exhibiting the desired Goss or cube-on-edge texture and the effect, and, during a latter part of the step of texture annealing the steel, of having boron being withdrawn from the steel because of the formation in the separator-agent coating or at the interface between it and the steel of borides of molybdenum and/or tungsten.

It was, in fact, even earlier discovered that, with respect to the making of high-permeability low-core loss, grain-oriented silicon steel of the kind wherein boron was added to the steel melt and used in the steel to promote selectively the growth of grains exhibiting the Goss texture, it would be possible to proceed by having the boron in the steel during the texture-anneal step and then conducting the removal of boron from the steel by a process of subsequently providing the steel with a coating based on magnesium oxide and containing a suitable proportion of a compound of molybdenum and/or tungsten. This process is not shown in the Figures.

In FIG. 2, there is indicated a process which begins, as indicated by the box 14, with melting through final normalizing of a steel of suitable composition, in a conventional manner.

Next, as indicated in the box 16, there is applied to the steel a separator coating based on magnesium oxide and containing boron, but not any compound of molybdenum or tungsten. This step is conducted substantially in the same way as has been indicated above. In other words, there may be used, except for the differences in its composition, the same kind of slurry, under the same kinds of conditions with respect to line speed and drying of the coating in a tower furnace, as have hitherto been known and used in the art. The steel is then final texture annealed, as indicated in the box 18, and scrubbed, as indicated in the box 20.

Then, in accordance with this embodiment of the invention, the steel is provided with a separator-agent coating based on magnesium oxide which contains a compound of molybdenum and/or tungsten but not any boron, this step being indicated in the FIG. 2 by the box 22. Further details about how this step is to be accomplished will be apparent from what is said hereinbelow.

After the coating-applying step of the box 22, the steel is given a further annealing treatment at a high temperature in a reducing atmosphere, and in FIG. 2, this step is indicated by the box 24. This step may again be a heating in dry hydrogen for at least 2 hours at 2150 degree F., followed by a slow cooling.

In accordance with the method shown in FIG. 2, this step is followed by a step of scrubbing the steel, as is indicated by the box 26, and then, optionally, as indicated by the dotted line 28, an optional step, indicated by the box 30, of then further processing the steel, by tension-coating or scribing, to improve the electrical properties of the product.

Figure 3:
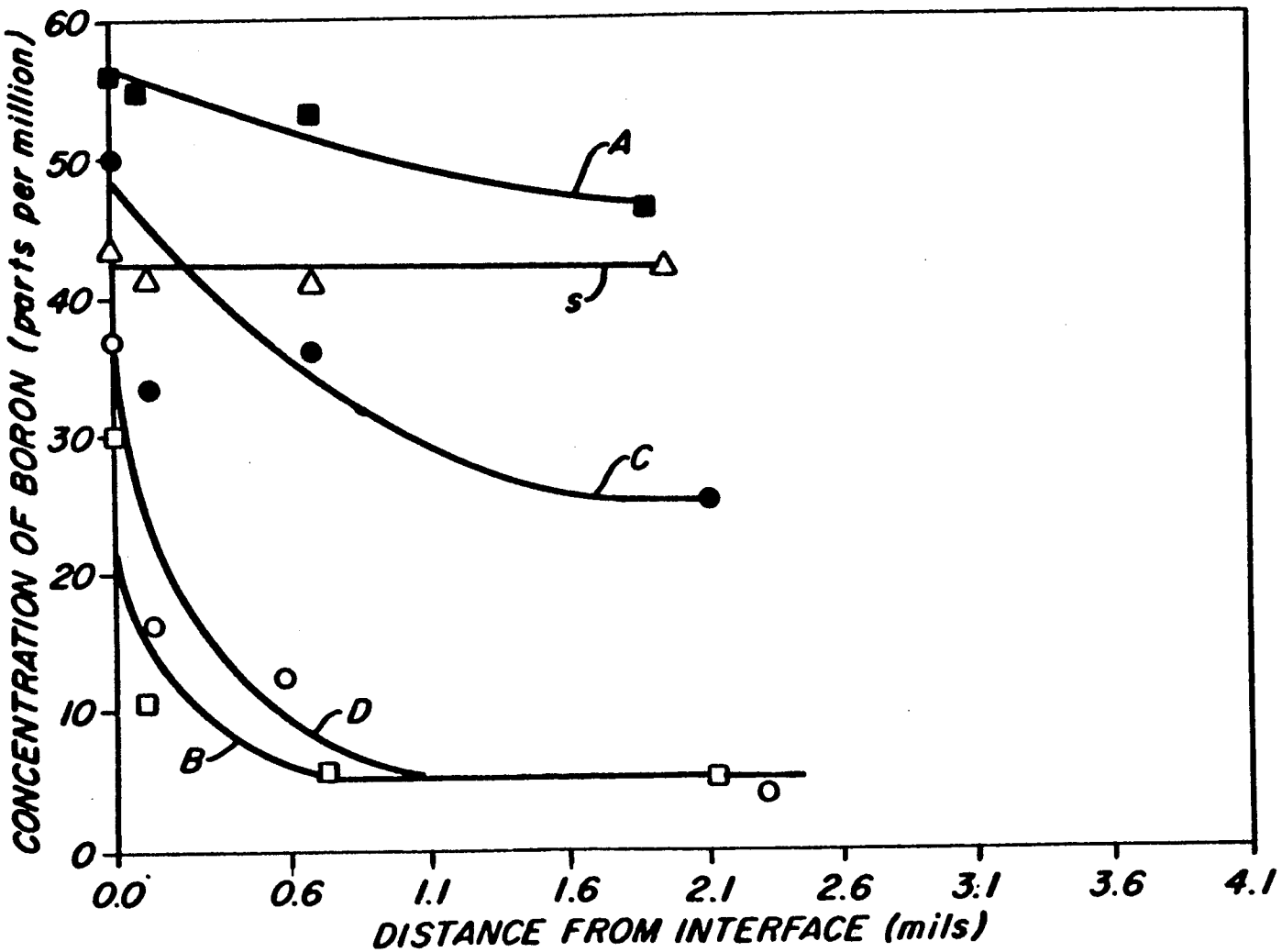
FIG. 3 is a graph which illustrates how the boron content of the steel after high-temperature annealing varies at various distances from the interface between the steel and the coating as a function of the coating composition.

Referring now to FIG. 3, additional tests were conducted to establish how the boron content of the steel would vary, after the high-temperature-anneal heat treatment, at various distances into the strip (which was 0.0086 inch thick) away from the interface between the coating and the steel as a function of coating composition.

From the data which are presented, in the standard, as-scrubbed steel, the boron level remains steady at about 42 parts per million. The curves A and C, for coatings that contained both molybdenum and boron, but equal weights of each, show an effect that the molybdenum is causing at least some migration of boron towards the interface. It is apparent, however, that these compositions, having both added boron and added molybdenum, are not rich enough in molybdenum to cause boron to be removed from the steel. The curves B and D, on the other hand, which relate to compositions where the weight percentage of molybdenum is double that of the boron, show that the steel at more than about 1 mil from the interface has been deboronized down to a level of about 4 parts per million. Thus, in compounding separating-agent coatings for use in the practice of the invention in its aspect of doing the ductilizing during the final texture anneal, it is desirable to use a composition which contains, for each part by weight of boron, at least two parts by weight of molybdenum or four parts by weight of tungsten.

A principle of the present invention is that there shall be practiced a method for making grain-oriented silicon steel wherein boron is used for improving core loss and permeability values. Boron may be added to the steel melt or to a separator coating applied to the steel to effect the growth of grains in the said steel during a final texture anneal thereof, a selective effect which favors the growth of grains, namely those having the desired Goss or cube-on-edge texture. There may also be practiced during a final annealing of the steel (whether for the development of grain-oriented texture or not) the use of a separating-agent coating, preferably an aqueous slurry based upon magnesium oxide, to which there has been added some substantial and effective amount of a compound of molybdenum and/or tungsten. By means of the annealing treatment in which there is used such a separating-agent coating having an effective content of molybdenum and/or tungsten, there may be obtained a product which is relatively low in boron content in the steel and is characterized by having a significantly improved degree of ductility for a boron containing, grain-oriented silicon steel. In particular, for a high-permeability grain-oriented silicon steel which is made with the use of boron to favor the growth of the grains imparting Goss texture, any degree of ductility such that a sheet of the steel having a thickness of 1 to 15 mils which may be bent more than twice by 180 degrees, without rupturing, is a good degree of ductility. In accordance with the invention, it has been found that with the use of slurries based upon magnesium oxide and having appropriate additions of compounds of tungsten and/or molybdenum, whether in the final texture anneal or in a separate subsequent high-temperature anneal, it is possible to obtain a product which will have acceptable electrical and/or magnetic properties for a grain-oriented silicon steel. At the same time, the steels will exhibit a degree of ductility such that the steel, in the form of sheets about as thick as mentioned above, may be bent through 180 degrees in excess of three times before rupturing, and this is an effect which has never hitherto been observed on a consistent basis in boron containing, grain-oriented silicon steel sheet or strip products.

The invention is further explained and illustrated by the following specific examples.

EXAMPLE 1

There was prepared a coil of grain-oriented silicon steel of the high-permeability type, the material having a final gauge thickness of 0.0086 inch. The composition of the steel was within the usual ranges for a steel product melted to satisfy the following aim specification, namely, one having, in weight percent,

| | |
|---|---|
| C | 0.03 |
| Mn | 0.035 |
| S | 0.0017 |
| Si | 3.15 |
| Cu | 0.30 |
| B | 0.001 |
| N | less than 0.005 |
| Fe | balance, essentially, except for low concentrations of other impurities in amounts insufficient to affect the properties. |

The material was mill-processed through the steps of final texture annealing and scrubbing to remove the separator-coating material which had been applied before the final texture annealing. Epstein strip packs were cut from such material, marked for identification, and given a stress-relief-annealing (SRA) heat treatment at 1475 degrees F. for 4 hours in an atmosphere of dry hydrogen gas. The strips in the SRA condition were evaluated for magnetic properties and for ductility. The testing for magnetic properties consisted of determining the magnetic permeability and the core loss by the usual procedures. The ductility test was determined by the number of 180-degree bends in which the strip could be bent in a vice before the strip failed by rupture.

In the as-stress-relief-annealed condition, the strip had substantially no ductility, rupturing in the making of the first 180-degree bend In the testing for magnetic properties, it exhibited a magnetic permeability of 1894, at 10 oerstads, a core loss of 0.406 watts per pound at 15 kilogauss and 60 cycles per second. These test results for magnetic properties are all acceptable values for a commercially salable product, but not as good as sometimes obtained with the use of other special procedures.

The as-stress-relief-annealed strips were then subjected to a coating with a separating coating based on magnesium oxide, but one to which both boron and molybdenum had been added. To be more specific, there was prepared and used, in a manner that is customary in my research concerning the effects of varying the composition of such separator-coating slurries, a slurry in which the dry ingredients comprise 50 grams of magnesium oxide, 2.2 grams of boric acid, and 20 grams of molybdenum trioxide. These are mixed with 400 cubic centimeters of water to form a slurry that corresponds to that obtained by mixing the same numbers of pounds of the same dry ingredients with 40 gallons of water. A separator coating was applied and dried, and strips were then annealed in dry hydrogen gas at 2100 degrees F. for 4 hours and cooled at 30 degrees F. per hour and again tested for ductility and magnetic properties.

In the tests of magnetic properties, the strips exhibited for magnetic permeability of 1887 at 10 oersteds, a core-loss value of 0.407 watts per pound at 15 kilogauss and 60 hertz. Although the magnetic permeability was decreased somewhat, it remained within the acceptable range for high-permeability material (over 1870). The core-loss value is substantially the same as the value for the steel in the condition as stress-relief—annealed.

More striking is the result in the ductility test. The tested strips survived seven or eight 180-degree bends before rupturing.

EXAMPLE 2

Example 1 was repeated, but with steel from a different mill-processed coil of steel of about the same chemical composition, with the results as indicated below in Table I both before and after coating with molybdenum-containing coating, in which the values from Example 1 are repeated for comparison.

TABLE I

| | μ-at 10H | | @ 15 KG Core Loss, WPP | | Ductility | |
|---|---|---|---|---|---|---|
| Ex. | Bef. | Aft. | Before | After | Before | After |
| 1 | 1894 | 1887 | 0.406 | 0.407 | 1 | 6.5 |
| 2 | 1926 | 1914 | 0.412 | 0.413 | 1 | 6 |

The foregoing results are for a practice which, though it illustrates the effectiveness of using a magnesium oxide coating with added molybdenum trioxide as a way of improving the ductility without undue sacrifice in other properties, does not correspond to the preferred manner of practicing the invention when there is used a procedure involving separate steps of recoating and annealing, after the final texture anneal.

In such a procedure, it is preferred, as indicated in FIG. 2, that there be used a magnesium oxide coating which contains added molybdenum trioxide (or tungsten trioxide) but does not contain added boron. Such preferred procedures are illustrated in the following Examples 3–7.

EXAMPLES 3–7

Example 1 was repeated, but in place of the MgO slurry made with 50 grams of magnesium oxide, 2.2 grams of boric acid, and 20 grams of molybdenum trioxide, there were made slurries by using:

C#2-50 grams of magnesium oxide plus 4.96 grams of molybdenum trioxide.

C#3-50 grams of magnesium oxide plus 9.92 grams of molybdenum trioxide.

C#4-50 grams of magnesium oxide plus 19.84 grams of molybdenum trioxide.

The results obtained in this work are presented below in Table II.

TABLE II

| | | μ at 10H | | @ 15 KG Core Loss, WPP | | Ductility | |
|---|---|---|---|---|---|---|---|
| Ex. | Coat | Before | After | Before | After | Before | After |
| 3 | C#3 | 1903 | 1895 | .405 | .403 | 1 | 7.5 |
| 4 | C#4 | 1896 | 1889 | .419 | .412 | 1 | 8 |
| 5 | C#2 | 1914 | 1907 | .414 | .414 | 1 | 9 |
| 6 | C#3 | 1926 | 1920 | .414 | .410 | 1 | 8 |
| 7 | C#4 | 1912 | 1900 | .406 | .405 | 1 | 8 |

COMPARISON TESTS A TO H

Example 1 was repeated, but with the use of slurries made by using:

C#5-50 grams of magnesium oxide, 4.28 grams of boric acid, and 9.92 grams of molybdenum trioxide.

C#6-50 grams of magnesium oxide, 4.28 grams of boric acid, and 19.84 grams of molybdenum trioxide.

C#7-50 grams of magnesium oxide, 2.14 grams of boric acid, and 4.96 grams of molybdenum trioxide.

C#8-50 grams of magnesium oxide, 2.14 grams of boric acid, and 9.92 grams of molybdenum trioxide.

The results of these tests are summarized below in Table III.

TABLE III

| | | μ at 10H | | @ 15 KG Core Loss, WPP | | Ductility | |
|---|---|---|---|---|---|---|---|
| Ex. | Coat | Before | After | Before | After | Before | After |
| A | C#5 | 1888 | 1878 | 0.403 | 0.417 | 1 | 1 |
| B | C#6 | 1894 | 1892 | 0.414 | 0.419 | 1 | 5 |
| C | C#7 | 1906 | 1900 | 0.398 | 0.402 | 1 | 1 |
| D | C#8 | 1911 | 1902 | 0.414 | 0.417 | 1 | 4.5 |
| E | C#5 | 1935 | 1926 | 0.414 | 0.414 | 1 | 1 |
| F | C#6 | 1932 | 1930 | 0.415 | 0.411 | 1 | 8.5 |
| G | C#7 | 1921 | 1914 | 0.417 | 0.418 | 1 | 1 |
| H | C#8 | 1922 | 1915 | 0.415 | 0.410 | 1 | 4 |

EXAMPLES 8–9

These relate to my work with an experimental procedure in which there was used, in the final texture anneal step, a separator-agent coating based on magnesium oxide, to which there had been added both boric acid and molybdenum trioxide.

There were prepared Epstein samples of mill final-normalized silicon steel from two different heats, the strip being of final gauge thickness of 0.0086 inch. These samples were provided with coatings based on magnesium oxide, using procedures the same as for Examples 1–7, except that the coating compositions were as follows:

C#9-50 grams of magnesium oxide plus 2.2 grams boric acid plus 10 grams molybdenum trioxide.

C#10-50 grams of magnesium oxide plus 2.2 grams boric acid plus 20 grams molybdenum trioxide.

C#11-50 grams of magnesium oxide and 2.2 grams of boric acid.

The annealing cycle to which these mill final-normalized samples was subjected included 10 hours at 1600 degrees F. in dry hydrogen, followed by 10 hours in dry hydrogen at 2150 degrees F., followed by a slow cooling at 25 degrees F. per hour.

The experimental results obtained in this work are summarized below in Table IV.

TABLE IV

| Ex | Coat | μ at 10H | Core Loss, WPP | Ductility |
|---|---|---|---|---|
| 8 | C#9 | 1876 | 0.417 | 4 |
| 9 | C#10 | 1894 | 0.415 | 5 |

EXAMPLE 10 AND COMPARISON TEST I

To confirm the results obtained with the coatings designated C#9 and C#10 hereinabove, there were conducted further tests in which Example 8 was repeated, using either of the above-mentioned coatings or the "standard" coating, C#11.

The results of this work are presented below in Table V,

TABLE V

| Ex. | Coat | μ at 10H | @ 15 KG Core Loss, WPP | Ductility |
|---|---|---|---|---|
| 19 | C#9 | 1895 | 0.409 | 5 |
| I | C#11 | 1903 | 0.404 | 2 |

EXAMPLES 11–13

Either Example 1 or Example 8 was repeated, but with the use, this time, of a coating based upon magnesium oxide to which there had been added a tungsten compound. The results are in TABLE VI.

TABLE VI

| | | | μ at 10H | | @ 15 KG Core Loss, WPP | | Ductility | |
|---|---|---|---|---|---|---|---|---|
| Ex. | Proc. | Coat | Bef. | Aft. | Bef. | Aft. | Bef. | Aft. |
| 11 | FIG. 2 | C#12 | NT | 1889 | NT | .412 | NT | 6 |
| 12 | FIG. 2 | C#13 | NT | 1909 | NT | .420 | NT | 6.5 |
| 13 | FIG. 2 | C#14 | NT | 1916 | NT | .419 | NT | 6 |

"NT" = Not Tested

Coating C#12 had 40 weight percent tungsten.

Coating C#13 had 12.2 weight percent tungsten.

Coating C#14 had 21 weight percent tungsten.

No boron in each case. The heat treatment was 5 hours at 2100 degrees Fahrenheit in hydrogen. These were, as indicated, recoats after texture annealing.

MODIFICATIONS AND EQUIVALENTS

Although the term "molybdenum compound" has been used freely hereinabove, it is to be understood that, as those skilled in the art will readily appreciate, by no means are all of the compounds of molybdenum suitable or effective for the purposes of the invention. For example, molybdenum boride is utterly unsuitable, because it has no capacity for reacting with boron. Molybdenum fluoride, if it were available, could be expected to be (apart from its cost) unsuitable for the same reason. Molybdenum disulfide is a known molybdenum compound and one that is readily commercially available, it being a lubricant, but those skilled in the art would be disinclined to use it because of the chance that it would impart sulfur to the steel and embrittle it—either that, or react with the hydrogen of the reducing atmosphere in the steel to form hydrogen sulfide, which is both toxic and evil-smelling (rotten egg). The other halides (chloride, bromide, iodine) are unpromising because of potential acid formation or cost. On the other hand, a silicide or nitride of molybdenum or a ferromolybdenum would appear to afford the desired reactivity while avoiding the generation of any harmful reaction product. If a compound of molybdenum is to be used, the trioxide appears to be the compound of choice, but one could almost surely employ the molybdic acid of which the trioxide is an anhydride.

Any tungsten compounds which are metallurgically satisfactory are likely to be preferable to their molybdenum counterparts in respect to being less volatile.

While I have shown and described herein certain embodiments of my invention, I intend to cover any changes or modifications therein which may be made without departing from its spirit and scope.

I claim as my invention:

1. A composition of matter for use in deboronizing grain-oriented silicon steel having boron therein, said composition being in the form selected from the group consisting of dry powder and aqueous slurry made therefrom, said composition consisting essentially of boron, on a dry-solids basis, 5 to 20% by weight of an agent selected from the group consisting of molybdenum compounds and tungsten compounds and the remainder magnesium oxide, wherein the composition contains, per one part by weight boron, at least 2 parts by weight of molybdenum or at least 4 parts by weight of tungsten.

2. A composition as defined in claim 1 wherein said agent is molybdenum trioxide.

3. A composition as defined in claim 1 wherein said agent is tungsten trioxide.

4. A composition as defined in claim 1 wherein said agent is tungstic acid.

5. A composition as defined in claim 1 wherein said agent is molybdic acid.

* * * * *